US008057149B2

(12) United States Patent
Kaneko

(10) Patent No.: US 8,057,149 B2
(45) Date of Patent: Nov. 15, 2011

(54) BOOKBINDING APPARATUS AND BOOKBINDING SYSTEM

(75) Inventor: Masahiro Kaneko, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 875 days.

(21) Appl. No.: 11/861,023

(22) Filed: Sep. 25, 2007

(65) Prior Publication Data

US 2008/0304934 A1 Dec. 11, 2008

(30) Foreign Application Priority Data

Jun. 7, 2007 (JP) ..... 2007-151436

(51) Int. Cl.
*B42C 13/00* (2006.01)

(52) U.S. Cl. ..... 412/13; 412/11; 412/8; 156/64; 700/299

(58) Field of Classification Search ..... 156/359, 156/378; 700/299, 300; 412/8, 12, 13, 37, 412/11, 14
See application file for complete search history.

(56) References Cited

U.S. PATENT DOCUMENTS 6,093,279 A * 7/2000 Detterman et al. ..... 412/8
2006/0018734 A1* 1/2006 Nagaya et al. ..... 412/37

FOREIGN PATENT DOCUMENTS

JP 4-61673 5/1992
JP 2003-010748 1/2003
JP 2005-238526 9/2005
JP 2007-57580 3/2007
JP 2007-057580 3/2007

OTHER PUBLICATIONS

Japanese Office Action dated Jul. 17, 2009.

* cited by examiner

*Primary Examiner* — Dana Ross
*Assistant Examiner* — Pradeep C Battula
(74) *Attorney, Agent, or Firm* — Finnegan, Henderson, Farabow, Garrett & Dunner, LLP

(57) ABSTRACT

A bookbinding apparatus which forms a sheet bundle by aligning a plurality of sheets fed from an image forming apparatus and prepares a booklet by applying adhesive on a spine of the sheet bundle, the bookbinding apparatus includes: a storage member for storing the adhesive; a rotating member for rotating in contact with the adhesive in the storage member; a heater for melting the adhesive in the storage member and for heating the adhesive so as to reach a preset temperature; and a control device for controlling the preset temperature, at a termination of the bookbinding job, to switch from a first preset temperature for a time of bookbinding to a second preset temperature which is below the first preset temperature and equal to or above a melting point of the adhesive.

5 Claims, 9 Drawing Sheets

BOOKBINDING APPARATUS AND BOOKBINDING SYSTEM

RELATED APPLICATION

This application is based on Japanese Patent Application No. 2007-151436 filed on Jun. 7, 2007 in Japanese Patent Office, the entire content of which is hereby incorporated by reference.

TECHNICAL FIELD

The present invention relates to a bookbinding apparatus and bookbinding system for producing a booklet by gluing the spine of an aligned sheet bundle.

BACKGROUND OF THE INVENTION

In a widely used bookbinding apparatus for producing a booklet, image-recorded sheets are stacked to form a sheet bundle and the spine of this sheet bundle is applied with hot metal type adhesive, whereby binding operation is performed.

The adhesive applied on the spine of the sheet bundle is a solid mass at the normal temperature. A predetermined amount of adhesive is put into the hopper of the apparatus.

A proper amount of the solid adhesive in the hopper is fed to a melting tank as s storage member at a predetermined time interval. It is melted in a melting tank provided with a heater, and is kept at a preset temperature. The adhesive kept at the preset temperature is applied on the spine of the sheet bundle by a gluing device.

When continuous bookbinding is to be performed, the adhesive stored in the melting tank is preferably kept at the optimum preset temperature.

However, when a non-bookbinding mode continues for a long time, unwanted power consumption, deterioration of the adhesive or generation of offensive smell from the adhesive may result if the adhesive stored in the melting tank is kept at the optimum preset temperature.

Such a problem fails to meet the requirements of an office wherein greater importance is placed on energy saving, cost reduction and maintenance of a comfortable working environment.

In a bookbinding apparatus for solving the problem disclosed in the Unexamined Japanese Patent Application Publication No. 2007-57580, the heater is turned off upon termination of bookbinding operation, or the temperature is reduced to a level lower than the optimum preset temperature.

However, when the heater is turned off, the room temperature is reduced. Thus, the adhesive having been liquefied is again turned into a solid.

Thus, when gluing is performed, the adhesive in the solid state must be heated to the temperature wherein gluing is possible. This will consume a lot of time.

When switching the temperature to the level lower than the gluing temperature without turning off the heater, the time required for resetting is prolonged if the switching temperature is too low, If an application roller in contact with the adhesive is rotated before the solid adhesive is liquefied, the drive mechanism or drive circuit of the application roller may be damaged.

SUMMARY

One aspect of the present invention is to provide a bookbinding apparatus which forms a sheet bundle by aligning a plurality of sheets fed from an image forming apparatus and prepares a booklet by applying adhesive on a spine of the sheet bundle, the bookbinding apparatus includes: a storage member for storing the adhesive; a rotating member for rotating in contact with the adhesive in the storage member; a heater for melting the adhesive in the storage member and for heating the adhesive so as to reach a preset temperature; and a control device for controlling the preset temperature at a termination of the bookbinding job, to switch from a first preset temperature for a time of bookbinding to a second preset temperature which is below the first preset temperature and equal to or above a melting point of the adhesive.

DESCRIPTION OF THE PREFERRED EMBODIMENTS

Figure 1:
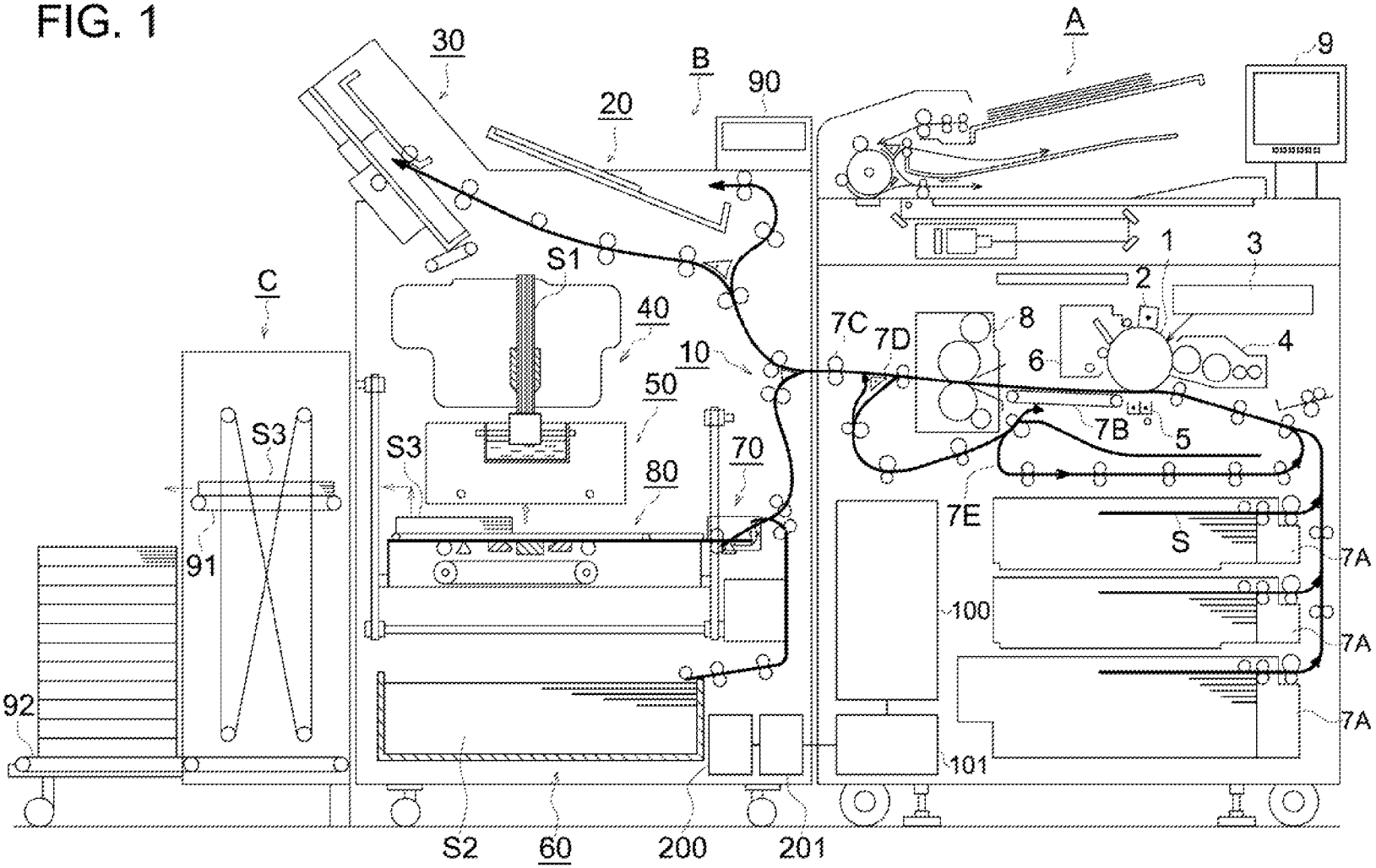
FIG. 1 is a conceptual diagram representing a bookbinding system.

Referring to drawings, the following describes the embodiments of the present invention:

FIG. 1 is a conceptual diagram representing a bookbinding system.

The illustrated bookbinding system includes an image forming apparatus A and bookbinding apparatus B. In the present embodiment, a booklet storage apparatus C for storing the booklet having been produced is connected to the bookbinding apparatus B.

The following describes the outline of the image forming apparatus and bookbinding apparatus.

[Image Forming Apparatus A]

The image forming apparatus A has an image forming device with a charging device 2, image exposure device 3, development device 4, transfer discharging device 5, and cleaning device 6 around the rotating image carrier 1.

After the surface of the image carrier 1 is uniformly charged by a charging device 2, the image forming device performs the operation of exposure and scanning based on the image data read from a document by the laser beam of the image exposure device 3, whereby a latent image is formed. This latent image is reversal-developed by the development device 4, and a toner image is formed on the surface of the image carrier 1.

The sheet S fed from the sheet storage device 7A is fed to the transfer position. At the transfer position, a toner image is transferred on the sheet S by the transfer discharging device 5. After that, the sheet S is discharged and is separated form the mage carrier 1. Then the sheet S is conveyed by the conveyance device 7B. This is followed by the step of heating and fixing by the fixing device 8, and is ejected from the sheet ejection roller 7C.

When an image is formed on both sides of the sheet S, the sheet S having been heated and fixed by the fixing device 8 is branched off from the normal sheet ejection passage by the sheet conveyance path switching device 7D, and is switched back by a reverse-conveyance device 7E so as to perform front-back reversion. After that, the sheet S again passes through the image forming section so that an image is formed on the rear face of the sheet S. The sheet S goes through the fixing device 8 to be ejected out of the apparatus by a sheet ejection roller 7C. The sheet S having been ejected from the sheet ejection roller 7C is fed into the bookbinding apparatus B.

A developer remaining on the surface is removed from the surface subsequent to image processing of the image carrier 1 by the cleaning device 6 so as to get ready for the next image formation procedure.

An operation and display device 9 equipped with an inputting device and display device is arranged on the upper portion of the image forming apparatus A.

[Bookbinding Apparatus B]

The bookbinding apparatus B of the present invention is provided with a sheet conveyance device 10, sheet ejection device 20, sheet bundle storage device 30, sheet bundle conveyance device 40, gluing device 50, cover sheet supply device 60, cover sheet trimming device 70, cover sheet supporting device 80, operation and display device 90.

The sheet S with an image formed thereon by the image forming apparatus A is fed by the sheet conveyance device 10, and a plurality of sheets S are stacked by a sheet bundle storage device 30, whereby a sheet bundle S1 is formed.

The sheet bundle S1 is conveyed to a predetermined position by the sheet bundle conveyance device 40, and the spine of the sheet bundle S1 is glued by the gluing device 50.

The glued spine of the sheet bundle S1 is bonded with the cover sheet S2 supported by the cover sheet supporting device 80, and the sheet bundle S1 is bent along both edges of the spine of the sheet bundle S1, whereby a booklet S3 is produced.

The following describes the details of each process of bookbinding:

The sheet S led to the sheet conveyance device 10 is fed to one of the sheet ejection device 20, sheet bundle storage device 30, and cover sheet supporting device 80 by a plurality of conveyance rollers, and sheet conveyance path switching gate.

When there is no instruction for bookbinding, the sheet S ejected from the image forming apparatus A is directly received into the sheet ejection tray of the sheet ejection device 20 according to the setting of the sheet conveyance path switching gate.

Figure 2:
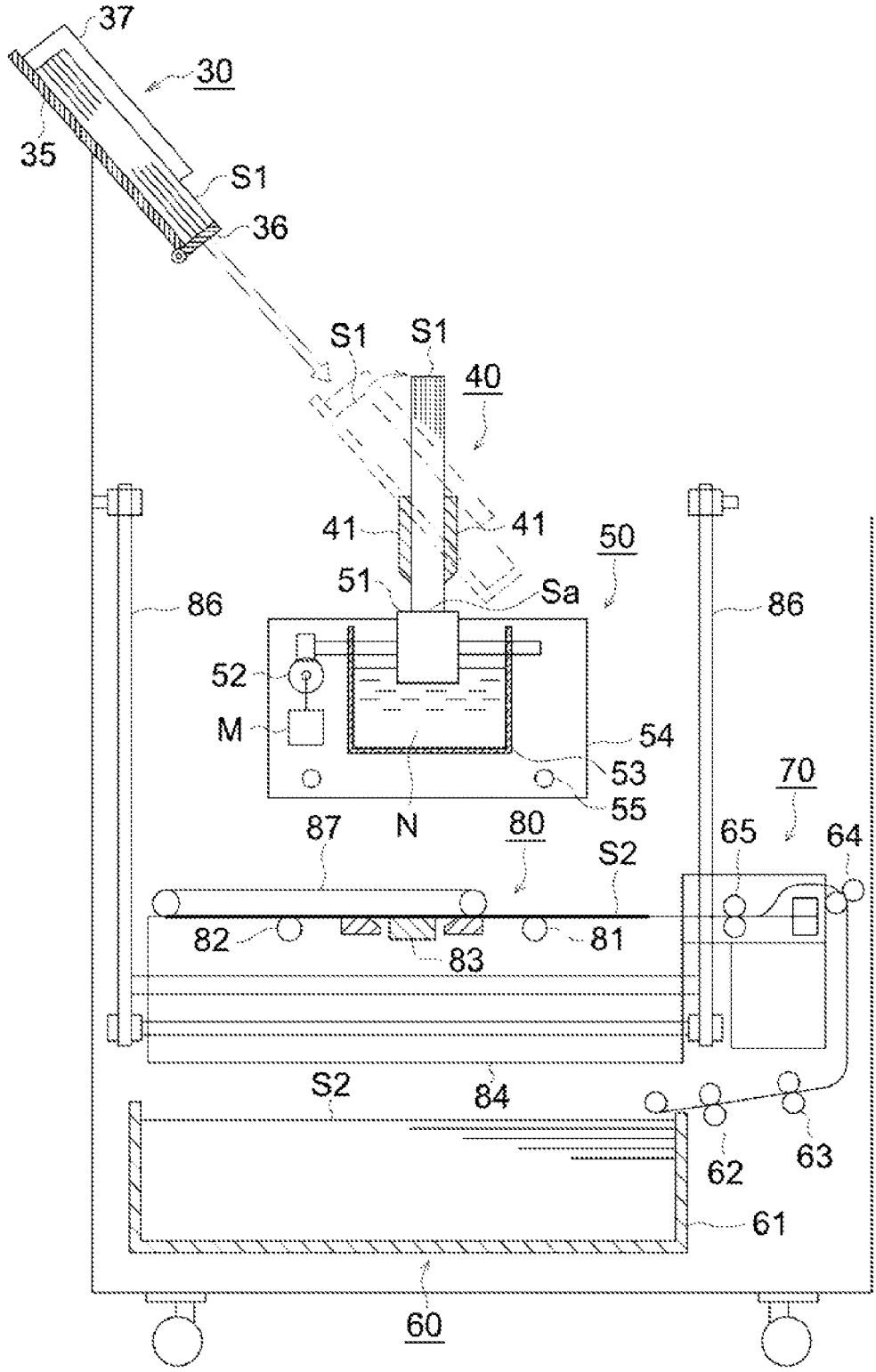
FIG. 2 is a conceptual diagram representing a bookbinding apparatus to explain the formation of a sheet bundle and subsequent processes.

FIG. 2 is a conceptual diagram representing a bookbinding apparatus to explain the formation of a sheet bundle S1 and subsequent processes;

The sheet bundle storage device 30 includes a sheet placement table 35 installed on an inclined position, a sheet trailing end positioning member 36 movably arranged, and an alignment member 37 for aligning the sheet across the width.

The sheets S ejected from the image forming apparatus A and conveyed by the sheet conveyance device 10 are sequentially placed on the sheet placement table 35, whereby a sheet bundle S1 made up of a predetermined number of sheets is formed.

After having been aligned, the sheet bundle S1 placed on the sheet placement table 35 of the sheet bundle storage device 30 is held by a holding device 41. When the sheet bundle S1 has been held by the holding device 41, the sheet trailing end positioning member 36 is moved by a drive device (not illustrated) and is retracted below the sheet placement table 35.

After having moved in the obliquely to the bottom shown by the broken line, the holding device 41 holding the sheet bundle S1 is rotated and holds the sheet bundle S1 in the upright position so that the spine Sa of the sheet bundle S1 to be glued is located downward. Then the holding device 41 stops at a predetermined position.

In the meantime, the cover sheet S2 stored inside the cover sheet stacking device 61 of the cover sheet supply device 60 is separated and fed by the sheet feed device 62, and is sandwiched between conveyance rollers 63, 64 and 65. It is conveyed by the conveyance rollers 81 and 82 of the cover sheet supporting device 80, and is then stopped at a predetermined position.

When the length of the cover sheet S2 is greater than the length required for folded binding of the sheet bundle S1, the cover sheet S2 is trimmed by the cover sheet trimming device 70 arranged on the right of the conveyance roller 65 so that the excess portion is removed in advance.

Figure 3:
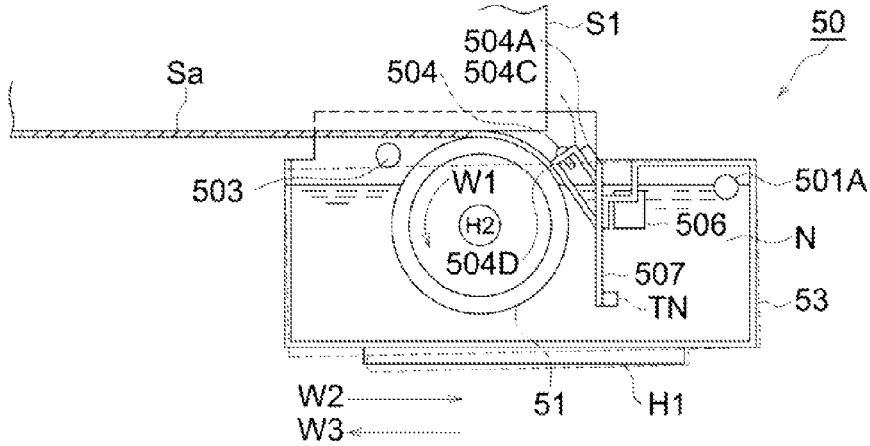
FIG. 3 is a conceptual diagram representing a gluing device.

FIG. 3 is a conceptual diagram representing a gluing device 50.

Figure 4:
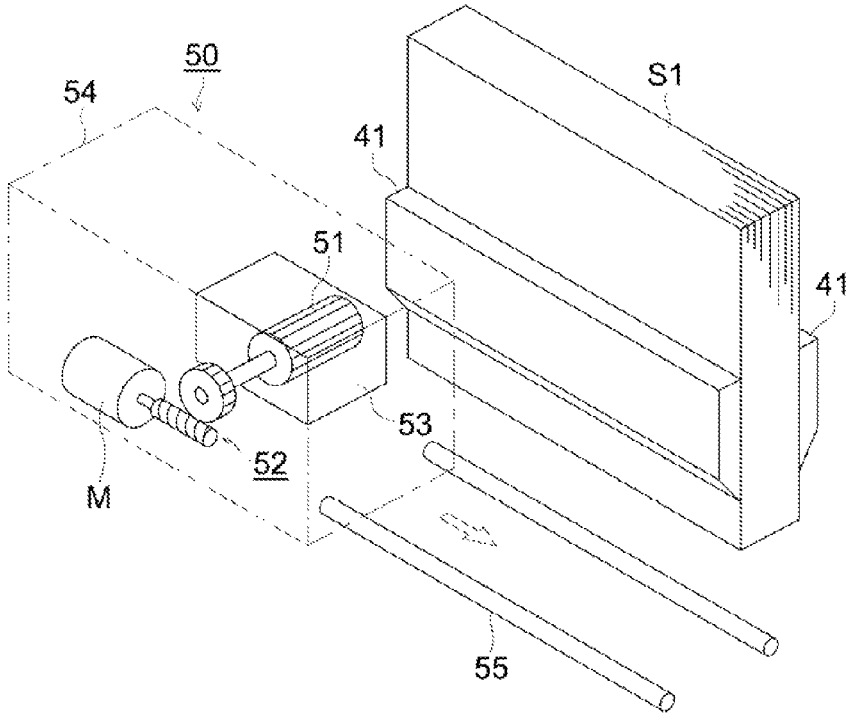
FIG. 4 is a perspective view of a gluing device and a sheet bundle held by a holding device.
Figure 5:
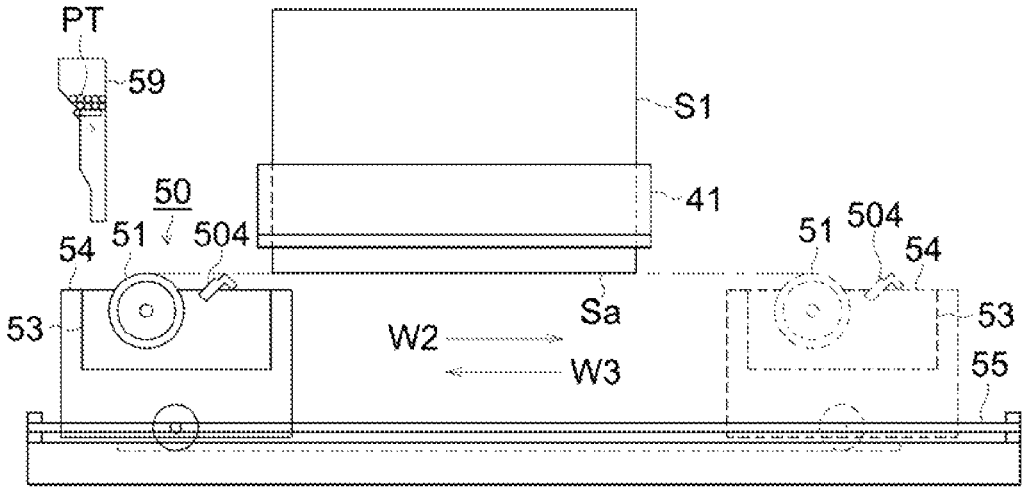
FIGS. 5*a*-5*b* a diagram explaining the operation of the gluing device.
Figure 5:
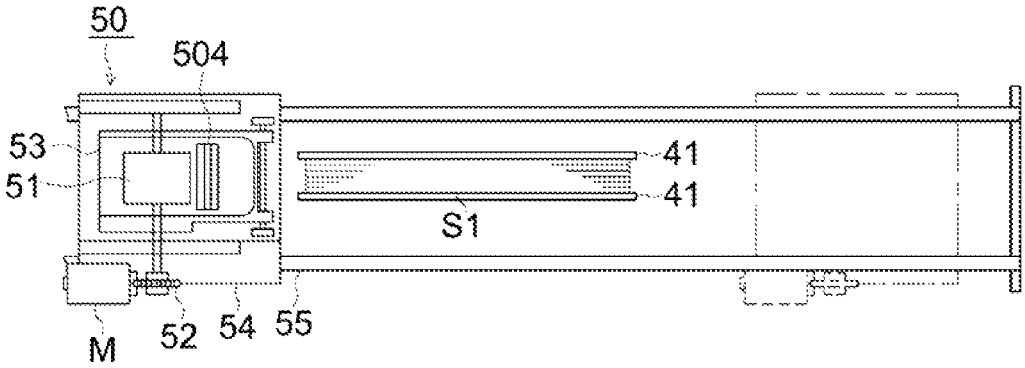

FIG. 4 is a perspective view of a gluing device 50 and a sheet bundle S1 held by a holding device 41. FIG. 5 is a diagram explaining the operation of the gluing device 50.

FIG. 5 (*a*) is a side view and FIG. 5 (*b*) is a top view.

The gluing device 50 has a melting tank 53 as a storage member for storing the adhesive N, a application roller 51 as an adhesive applying member, a regulating member 503, a scraping device 504, a heaters H1 and H2, an adhesive temperature sensor TN, and a residual sensor 506.

The reference numeral 59 is a supply apparatus for supplying solid adhesive PT, and supplies the mass-like solid adhesive PT, based on the signal of the residual sensor 506 for detecting the amount of adhesive in the melting tank 53. Heaters H1 and H2 are provided on the outer peripheral portion of the melting tank 53 and inside the application roller 51. The solid adhesive PT supplied to the melting tank 53 is heated to a predetermined temperature and is melted to become an adhesive N just before being applied.

The solid adhesive PT is supplied from the supply apparatus 59 in response to the detection signal of the residual sensor 506, and the amount of the supplied adhesive N is kept so that the liquid level is constant at all times.

The reference numeral 503 denotes a rod-like regulating member having an almost circular cross section and the 504 indicates a scraping device. They are secured on the plate-formed support member 507 by screwing both ends outside the adhesive-applied area. The melting tank 53 is set to the adhesive-applied status indicated by a solid line, from the standby status indicated by a dotted line by rotating about the shaft 501 A.

The scraping device 504 is a device to scrape off the adhesive using the main scratching section 504 A of the edge section at the uppermost position and the auxiliary scraping section 504C located slightly below the main scratching section 504 A, to ensure that the adhesive applied on the spine of the sheet bundle S1 by the application roller 51 will have a predetermined thickness.

The regulating member 503 is a member for regulating the adhesive-applied thickness, installed on the side opposite the scraping device 504, with the application roller 51 sandwiched in-between.

The reference numeral 54 denotes a traveling body for supporting the melting tank 53. The traveling body 54 starts traveling in the direction W2 from the initial position (on the left end of FIG. 5 (*a*)) on the spine side of the bookbinding apparatus B. Moving along the guide 55, the traveling body 54 stops at a predetermined position on the front of the bookbinding apparatus B, and is then reverse-driven in the direction W3 to get back to the initial position.

To be more specific, applying of adhesive on the spine SA of the sheet bundle S1 held at the upright position is performed by the back-and-forth motion of the application roller 51 with respect to the spine SA of the sheet bundle, wherein the application roller 51 is immersed in the adhesive of the melting tank 53 and is rotated by a motor M and drive means 52. The amount of the adhesive N to be applied is regulated is regulated mainly by the regulating member 503 at the time of outward movement (in the direction of W2), while the amount of the adhesive N to be applied is regulated mainly by the scraping device 504 at the time of homeward movement (in the direction of W3).

Figure 6:
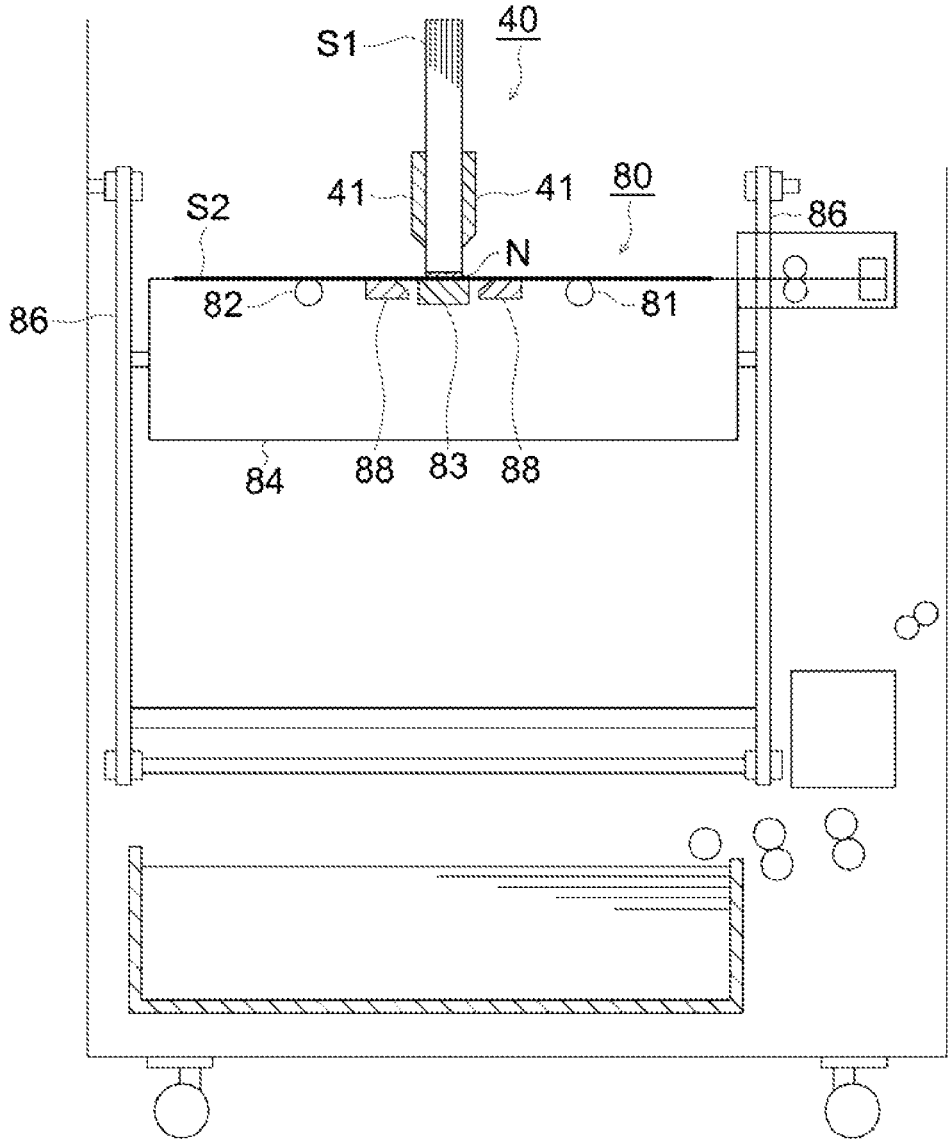
FIG. 6 is a conceptual diagram showing the position of a sheet bundle conveyance device and cover sheet supporting device.

FIG. 6 is an conceptual diagram showing the position of a sheet bundle conveyance device 40 and cover sheet supporting device 80 when the sheet bundle S1 are bonded with the cover sheet S2.

After completion of gluing the sheet bundle S1, the elevating device 86 moves the traveling enclosure 84 to a rise position as a predetermined position using a drive device. At this rise position, the center of the cover sheet S2 placed on the pressure member 83 is pressed against the adhesive-applied surface of the sheet bundle S1, and the cover sheet S2 is bonded with the sheet bundle S1.

Figure 7:
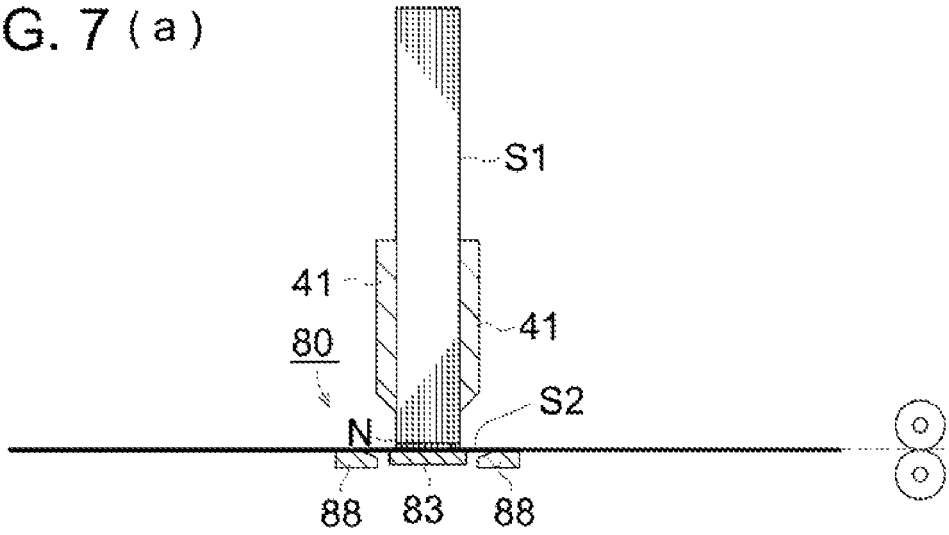
FIGS. 7*a*-7*d* is a cross sectional view of the cover sheet supporting device and the sheet bundle, illustrating the process of folding the cover sheet S2.
Figure 7:
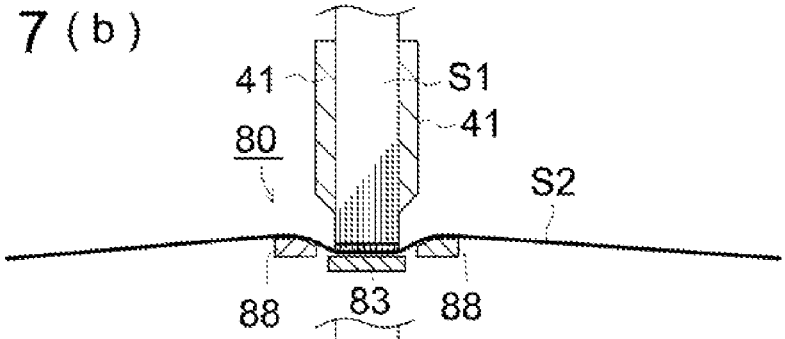
Figure 7:
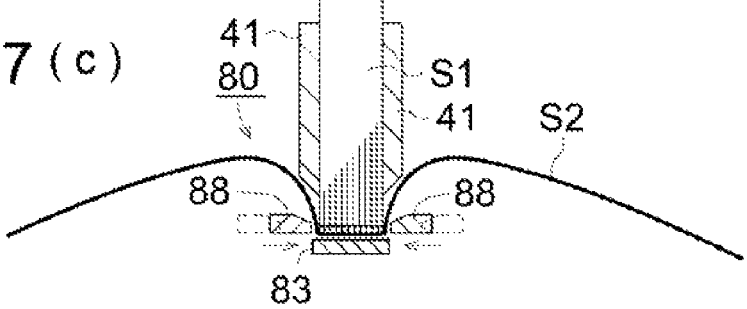
Figure 7:
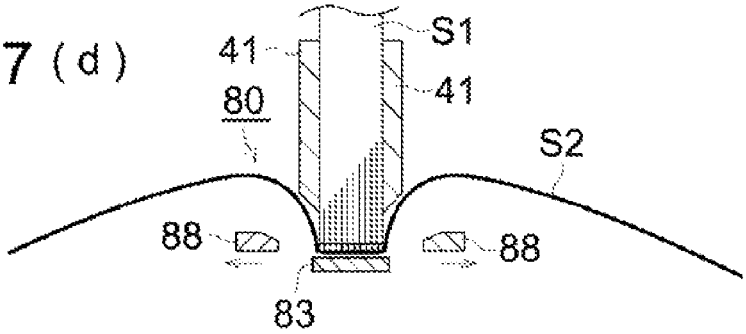

FIG. 7 is a cross sectional view of the cover sheet supporting device 80 and the sheet bundle S1, illustrating the process of folding the cover sheet S2. FIG. 7 (*a*) shows the case wherein folding of the cover sheet has just started; FIG. 7 (*b*) shows the case wherein the cover sheet is in the process of being folded; FIG. 7 (*c*) shows the case wherein folding of the cover sheet has completed; and FIG. 7 (*d*) shows the case wherein the pressure for folding the cover sheet is released.

After the cover sheet S2 is bonded to the spine SA of the sheet bundle S1 applied with adhesive N, a pair of folding member 88 of FIG. 6 is driven by the drive device (not illustrated) when the cover sheet supporting device 80 has moved upward. Then the holding member 41 holding the sheet bundle S1 goes downward. When the sheet bundle S1 goes downward, the cover sheet S2 is sandwiched between a pair of folding members 88 and is fed downward. The sheet bundle S1 is folded from the side edge of the adhesive-applied surface.

After that, a pair of folding members 88 moves toward the adhesive-applied surface of the sheet bundle S1 in the horizontal direction. Both sides of the sheet bundle S1 are pressed and reshaped, whereby a booklet S3 is formed.

The booklets S3 ejected by the ejection belt 87 are placed on the vertically movable conveyance belt 91 of the booklet storage apparatus C of FIG. 1. They are sequentially ejected by rotation of the conveyance belt 91, and are stacked and stored on the sheet ejection base 92.

The adhesive used in the bookbinding apparatus described above is a hot metal type adhesive. After mass-like solid adhesive PT is put into the melting tank 53 and is melted, temperature management is provided so as to maintain the temperature suitable to applying.

The temperature management is performed by the control device C controlling the heaters H1 and H2 based on the signal from the adhesive temperature sensor TN.

However, as described above, bookbinding apparatus B is not always used on a continuous basis in an office.

Especially in a bookbinding system wherein the image forming apparatus A is linked with the bookbinding apparatus B, the bookbinding system is often used in the processing of the job other than bookbinding. This may prolong the standby time of the bookbinding apparatus.

To reduce the power consumption of the apparatus in such a standby time, the bookbinding apparatus of the present invention includes a power save mode in addition to the bookbinding mode as an operation mode for normal bookbinding operation. The power save mode is an operation mode wherein the apparatus is in the state of receiving the minimum power supply required to maintain the standby status.

Figure 8:
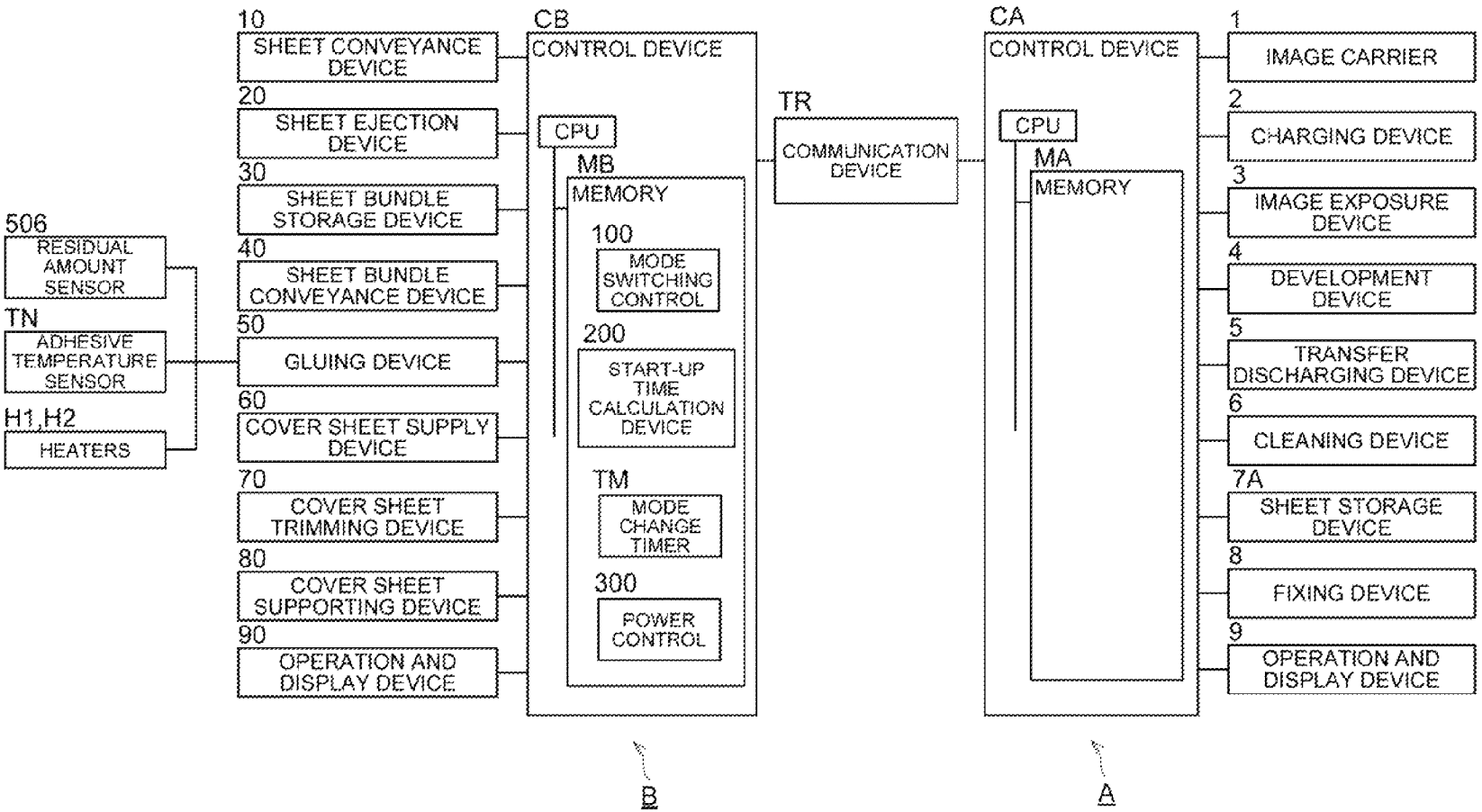
FIG. 8 is a block diagram showing the control relationship of the bookbinding system.

FIG. 8 is a block diagram showing the control relationship of the bookbinding system.

The image forming apparatus A has a control device CA, and the bookbinding apparatus B has a control device CB. The control devices thereof exchange information via the communication device TR.

The control device CA and control device CB are computer systems including a CPU, memory, computation unit, input/output interface circuit and drive circuit. Each control is provided by executing a predetermined program stored in the memory.

This drawing does not include the blocks not directly related to the description of the present invention.

Figure 9:
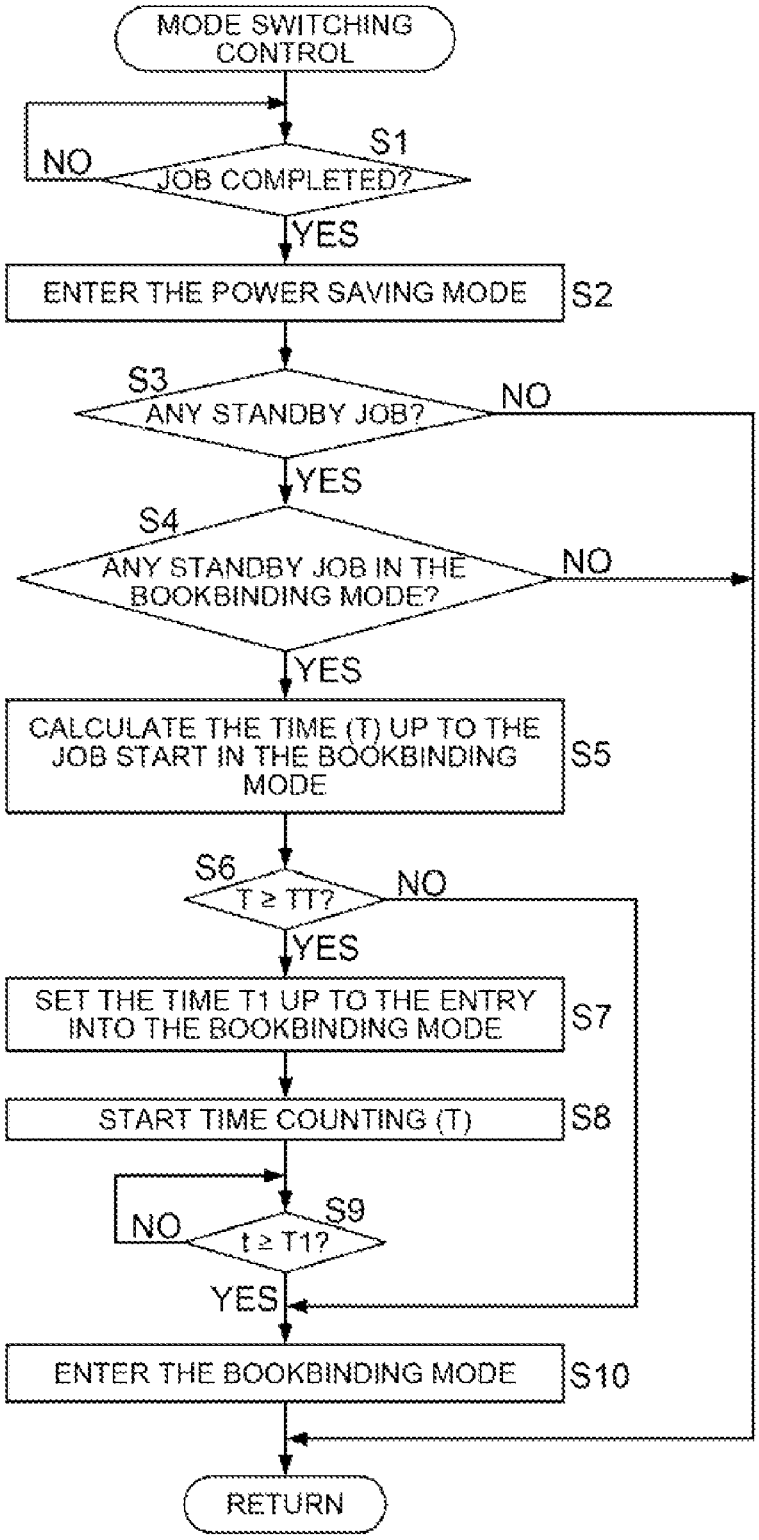
FIG. 9 is a flow chart showing the mode switching control in the bookbinding apparatus.

FIG. 9 is a flow chart showing the mode switching control 100 in the bookbinding apparatus B.

Upon completion of the bookbinding job (Y in Step S1), the control device CB enters the power save mode (Step S2).

In the power save mode, the preset temperature of the adhesive N in the melting tank 53 is reduced from the first preset temperature TN1 to the second preset temperature TN2. This reduces the power supplied to the heaters H1 and H2 for maintaining the preset temperature.

The first preset temperature TN1 is the adhesive temperature suited for applying. The second preset temperature TN2 is the temperature below the first preset temperature, and equal to or greater than the melting point of the adhesive.

When the second preset temperature TN2 is assumed as the melting point of the adhesive, excellent effect is ensured against deterioration of the power saving adhesive or generation of offensive smell.

In the meantime, when the difference between the second preset temperature TN2 and first preset temperature TN1 is reduced, it is possible to cut down the time for recovery from the second preset temperature TN2 to the first preset temperature TN1.

When the second preset temperature TN2 has been set to the level below the melting point of the adhesive, the adhesive is kept at the room temperature and is solidified. Thus, when the temperature is recovered to the first preset temperature, the application roller 51 cannot be rotated immediately.

Accordingly, the temperature of the adhesive in the melting tank 53 cannot be immediately recovered to the first preset level by the agitation of the adhesive by the application roller 51.

Should an attempt be made to rotate the application roller 51 when the adhesive in the melting tank 53 is solidified, excessive force will be applied to the motor as a drive source of the application roller 51, motor drive circuit, and application roller drive mechanism, and this may cause damage.

The preset temperature is determined by tests.

Then a decision step is taken to determine whether there is any standby job or not (Step S3). The job is set by the user using the operation and display device 9 of the image forming apparatus A or a personal computer connected to the image forming apparatus A via the network. The information on the setting procedure is shared by the control device CA and control device CB.

In the image forming system of this example, a plurality of jobs having been received are placed in the standby mode and are sequentially executed one by one.

If there is no standby job (N in Step S3), the system quits the processing routine. If there is s standby job (Y in Step S3), a decision is made to see whether or not there is any job in the bookbinding mode (Step S4).

If there is no such job (N in Step S4), the system quits the processing routine directly. If there is such a job (Y in Step S4), the time T to the start of the job in the bookbinding mode is calculated by the start-up time calculation device 200 which is a program (Step S5).

If the time T having been calculated is shorter than the preset time TT (N in Step S6), the power save mode is changed over to the bookbinding mode (Step S10), and the system quits the processing routine.

If the time T having been calculated is equal to or longer than the preset time TT (Y in Step S6), the time T1 for entering the bookbinding mode from the power save mode is set on the mode change timer TM (Step S7). Accordingly, a timing to change the preset temperature from the second preset temperature to the first preset temperature is the time T1 later.

The time T1 is set on the mode change timer TM when the time T calculated by the start-up time calculation device 200 is equal to or longer than preset time TT. This is intended to ensure that the temperature of the adhesive N reaches the first preset temperature suitable for gluing, immediately before adhesive is applied subsequent to the start of the job in the bookbinding mode.

The processing prevents adhesive temperature from rising to the first preset temperature before the start of the job in the bookbinding mode, also when the job in the bookbinding mode is preset, with the result that energy saving and prevention of adhesive deterioration are achieved.

The time TT is the time required to ensure that the temperature of the adhesive N maintained at the second preset temperature in the power save mode is raised to the first preset temperature in the bookbinding mode. This is determined by tests. The relationship between the time T having been calculated and the time T1 set on the mode change timer TM is given by T1=T−TT.

The mode change timer TM starts counting the time (Step S8). When the counted time t has reached the T1 (Y in Step S9), the power save mode changes over to the bookbinding mode (Step S10), and the system quits the processing routine.

When the adhesive temperature is recovered to the first preset temperature changed from the second preset temperature, the rotating member in contact with the adhesive in the storage member can be started immediately without damaging the drive mechanism. This arrangement ensures a quick start of adhesive agitation and reduces the recovery time when the adhesive temperature uniformly gets back to the first preset temperature.

In the example, the control device CB obtains information from the control device CA of the image forming apparatus A through the communication device TR, and the mode switching control of the bookbinding apparatus B is performed through the execution of the mode switching control 100 which is a program stored in the memory MB. It is also possible to make such arrangements that the control device CA obtains information from the control device CB of the bookbinding apparatus B through the communication device TR, whereby the processing corresponding to the flow from Step S3 through Step S9 is implemented. The result may be sent to the control device CB.

Further, in the bookbinding system of the present invention, the power supply mode of the bookbinding apparatus B is controlled, in relation to the power supply mode of the image forming apparatus A.

Figure 10:
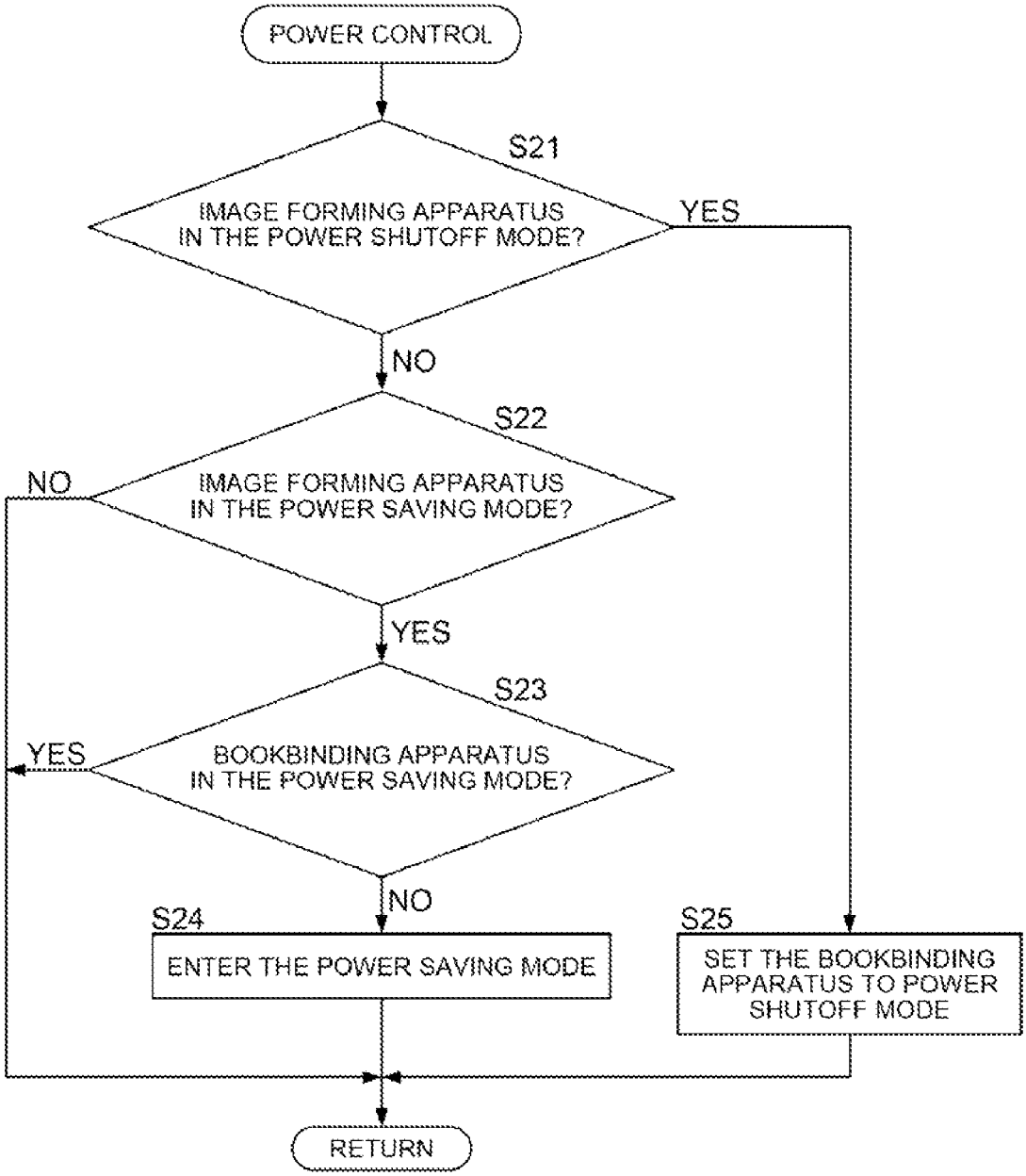
FIG. 10 is a flow chart showing the power control of the bookbinding apparatus.

FIG. 10 is a flow chart showing the power control 300 of the bookbinding apparatus B in relation to the power mode of the image forming apparatus A.

The control device CB of the bookbinding apparatus B identifies the mode of the power supplied to the image forming apparatus A from the control device CA of the image forming apparatus A through the communication device TR. If there is any power shutoff mode without power supply (Y in Step S21), the bookbinding apparatus B is set to the power shutoff mode (Step S25).

If power is on (N in Step S21), a decision step is taken to determine whether or not the image forming apparatus A is in the power saving mode (Step S22). The power saving mode refers to the standby mode of the image forming apparatus A wherein reduced power is being supplied to the devices as objects of power saving such as the fixing device 8.

If not in the power saving mode (N in Step S22), the system quits the processing routine. If in the power saving mode (Y in Step S22), a decision step is taken to determine whether or not bookbinding apparatus B per se is in the power save mode (Step S23).

If already in the power save mode, the system quits the routine directly. If not in the power save mode, namely, if already in the bookbinding mode, the system enters the power save mode (Step S24), and quits the processing routine.

In addition to the embodiment, it is also possible to make such arrangements that, when the control device CA changes the mode of the image forming apparatus A to the power shutoff mode or power saving mode, a switch signal is issued to the control device CB of the bookbinding apparatus B through the communication device TR. Upon receipt of this signal, the control device CB switches the bookbinding apparatus B to the power shutoff mode or power save mode.

As described above, the bookbinding apparatus or bookbinding system of the present invention reduces the power consumption of the bookbinding apparatus, prevents deterioration of the adhesive used in the bookbinding apparatus, and reduces the offensive smell generated from the adhesive.

What is claimed is:

1. A bookbinding apparatus which forms a sheet bundle by aligning a plurality of sheets fed from an image forming apparatus and prepares a booklet by applying adhesive on a spine of the sheet bundle, the bookbinding apparatus comprising:

a storage member for storing the adhesive;

a rotating member for rotating in contact with the adhesive in the storage member;

a heater for melting the adhesive in the storage member and for heating the adhesive so as to reach a preset temperature; and a control device for controlling the preset temperature, at a termination of the bookbinding job, to switch from a first preset temperature for a time of bookbinding to a second preset temperature which is below the first preset temperature and equal to or above a melting point of the adhesive;

wherein the control device, in a case where the control device judges that any job in the bookbinding mode is preset during a time when the preset temperature is set to the second preset temperature, calculates a time until a start of the preset job in the bookbinding mode, determines a time to change the preset temperature from the second preset temperature to the first preset temperature, and controls the heater to change the preset temperature from the second preset temperature to the first preset temperature based on the calculated time until the state of the preset job in the bookbinding mode.

2. The bookbinding apparatus of claim 1, wherein the second preset temperature is equal to the melting point of the adhesive.

3. The bookbinding apparatus of claim 1, wherein the control device controls the preset temperature to change from the first preset temperature to the second preset temperature in conjunction with the case that the image forming apparatus enters a power saving mode or a power shut off mode.

4. The bookbinding apparatus of claim 1, wherein the rotating member is an application roller for applying adhesive on the spine of the sheet bundle.

5. A bookbinding system comprising: an image forming apparatus and the bookbinding apparatus of claim 1.

* * * * *